United States Patent [19]

Giordano

[11] 4,115,947

[45] Sep. 26, 1978

[54] ACTION TOY AND AMUSEMENT DEVICE

[76] Inventor: Joseph A. Giordano, 213 S. Gray Ave., Colonial Heights, Wilmington, Del. 19805

[21] Appl. No.: 719,267

[22] Filed: Aug. 31, 1976

[51] Int. Cl.[2] ..... A63H 3/02

[52] U.S. Cl. ..... 46/116; 46/152; 272/8 N

[58] Field of Search ..... 46/116, 152, 233, 123; 272/8 N, 27 R

[56] References Cited

U.S. PATENT DOCUMENTS

| | | | |
|---|---|---|---|
| 2,836,931 | 6/1958 | Brennan | 46/152 |
| 3,674,616 | 7/1972 | Howard | 46/116 |
| 3,695,987 | 10/1972 | Wisotzky | 428/97 X |

*Primary Examiner*—Louis G. Mancene
*Assistant Examiner*—Robert F. Cutting
*Attorney, Agent, or Firm*—Connolly and Hutz

[57] ABSTRACT

An improved action toy and amusement device comprises a strip of rug material substantially longer than it is wide and having its nap material responsive to a user's finger being rubbed thereover to cause the strip of material to elevate and bend in snake-like movements.

1 Claim, 5 Drawing Figures

ACTION TOY AND AMUSEMENT DEVICE

BACKGROUND OF THE INVENTION

Various types of action toys and amusement devices are in existence. It would be desirable to provide such devices wherein readily available materials could be used, particularly materials which might otherwise be only scrap. It would further be desirable to utilize such materials with minimal modification thereto and yet provide an action toy and amusement device which can be manipulated and enjoyed by users of all ages.

SUMMARY OF THE INVENTION

An object of this invention is to provide such an action toy and amusement device which particularly lends itself to being made from such materials.

A further object of this invention is to provide such a device which functions in response to simple finger stroking motions of a user.

A still further object of this invention is to provide such a device whch is highly versatile in the types of results that can be achieved.

In accordance with this invention an improved action toy and amusement device comprises a strip of rug material substantially longer than it is wide and having its nap material responsive to the static electricity created by a user's finger being rubbed thereover to cause the strip of material to elevate and bend in snake-like movements.

Desirably one end of the strip has a simulated head formed thereon. This may be conveniently accomplished by angularly cutting opposite sides at one end thereof so that the end comes to a point which would simulate a nose and by providing simulated eyes thereon.

THE DRAWINGS

DETAILED DESCRIPTION

Figure 1:
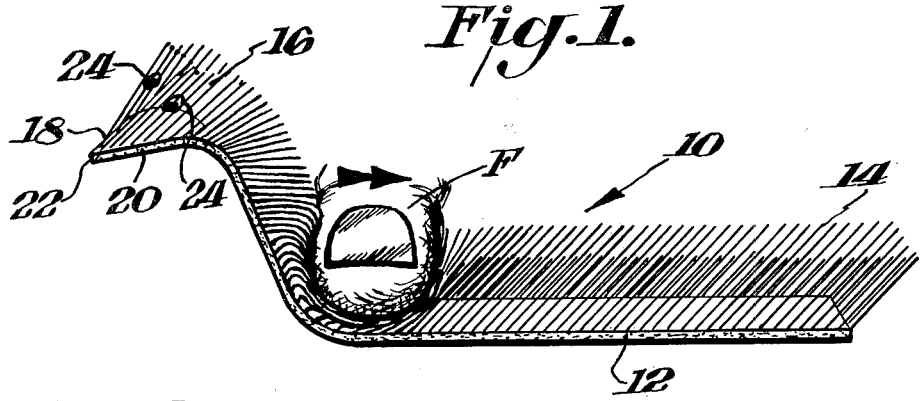
FIG. 1 is a pictorial view showing the action toy and amusement device in use.
Figure 2:
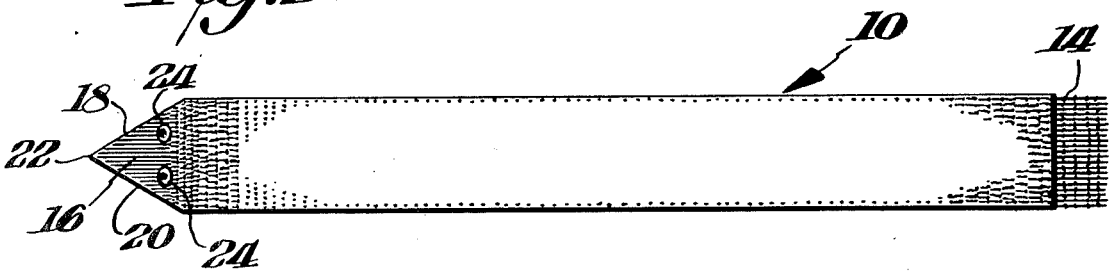
FIG. 2 is a top plan view of the device shown in FIG. 1.
Figure 3:
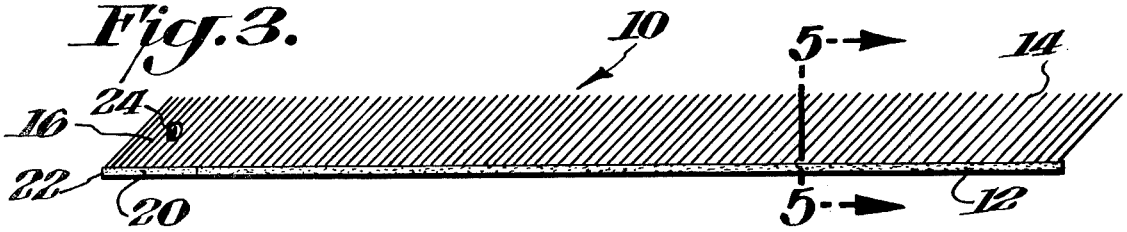
FIG. 3 is a side elevation view of the device shown in FIGS. 1–2.
Figure 5:
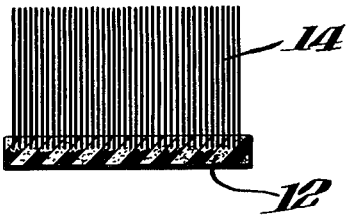
FIG. 5 is a cross-sectional view taken through FIG. 3 along the line 5—5.

As best shown in FIGS. 2–3 and 5 the action toy and amusement device 10 is made from rug material particularly remnants or odd sized material which might otherwise become scrap. In making the device 10 a thin strip of such material is cut in elongated form. The material comprises a conventional stiff yet flexible backing 12 and conventional nap material 14 extending upwardly (generally perpendicularly as shown in FIGS. 1 and 3) from one side of backing member 12. A simulated head 16 is formed at one end of the strip of material 12. In a preferred form of this invention opposed sides of material 12 is cut at an angle to form tapered sides 18 and 20 which meet at a point 22. The tapered end thus generally simulates the shape of a head with a point 22 simulating a nose. For added affect a pair of eyes 24 are incorporated in the simulated head portion 16. Eyes may be pasted or otherwise secured thereon or may simply be a pair of colored dots.

The invention is predicated upon the utilization of stroking of the user's finger to cause the toy 10 to go through its various movements. In this respect when the user's finger F is stroked in the longitudinal direction the strip 12 is caused to elevate and bend in snake-like or caterpillar type movements. Different types of strokes result in different movements. For example, if the stroking occurs in a direction toward the head, the tail end of the device would elevate and by proper movement tend to curl. Conversely, the same movements can be achieved in the head by stroking away from the head and toward the tail. In this manner with simple basic manipulations, i.e. finger stroking, countless variations of movements can be achieved from the device.

Figure 4:
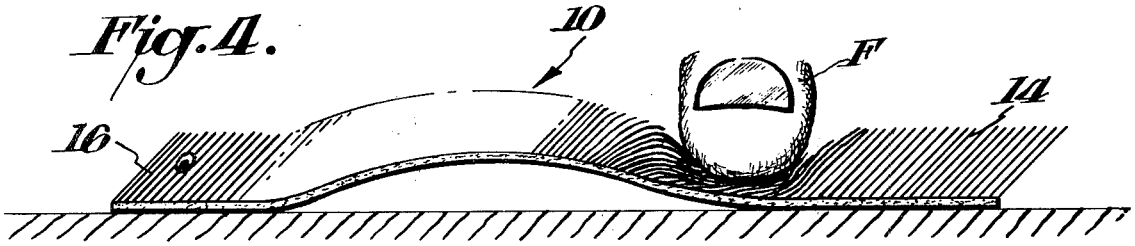
FIG.4 is a pictorial view similar to FIG. 1 showing the device in a different stage of use.

In other words as described above and illustrated in the drawings the finger is stroked from an upstream to a downward direction while the strip is on a support surface (FIG. 4) with the result being that the nap material is bent toward the horizontal and toward the backing member (FIGS. 1 and 4) in the direction of the stroke thereby causing the the nap material to raise the upstream backing material to result in the strip moving up and down with respect to the support surface (FIG. 4).

In order to obtain maximum amusement affect it is necessary to dimension device 10 so as to most effectively respond to the stroking. In the illustrated embodiment the length of device 10 is about 6½ inches while its width is about ¾ inches which of course is a width narrower than the length of the user's finger. In other words the length is about 8 times as long as the width. The larger the proportion of length to width becomes, the more effective will be the result of the stroking action. There should, however, be sufficient width so that the device will maintain enough resistance and stiffness to provide the desired results rather than simply automatically curling which would occur if the length/width ratio were too high. Conversely, if the length/width ratio is too low there will be a dampening affect on the tendency of the device to perform in its snake-like or caterpillar-type movements and, carried to an extreme, if the ratio is too low or if the device itself is made of too large a dimension the stroking might be totally ineffective in producing any movements.

The particular ratios may vary in accordance with the desired results and the selection of those ratios may be determined by those skilled in the art once given the teachings and suggestions of this invention.

It is also to be understood that device 10 may have other simulated body parts physically attached thereto such as arms, heads, legs, tails, etc. Alternatively, these simulated body parts may be cut from the rug scraps themselves.

Various types of renmant rug material may be used in the practice of this invention. Thus the rug material may have different types of backing and different types of nap. The primary consideration is that the material should respond to the stroking action to thereby result in the snake-like or caterpillar type movements previously described. Similarly, the concepts of this invention may be practiced with other materials and is not limited to rug material, per se. What is essential is that a base material be provided which renders the device sufficiently stiff yet flexible and that the upper side thereof include a substance such as nap or other fibers which readily responds to the stroking action.

As can be appreciated, the invention provides an inexpensive yet highly effective action toy and amusement device which is particularly desirable since it is made from material which might otherwise have no use. Further, great skill is not required by the user yet a wide variety of readily obtainable movements are possible.

What is claimed is:

1. A method of making and manipulating an action toy and amusement device comprising cutting a thin strip of rug material having upstanding nap material extending generally perpendicular to a stiff flexible backing member to a size about eight times longer in length than in width and of a width narrower than the length of the user's finger, cutting opposite sides of one end of the strip to form a pointed end, forming simulated eyes on the pointed end to form a simulated head thereby, and stroking the strip with the user's finger from an upstream direction to a downstream direction in its longitudinal direction while the strip is on a support surface to bend the nap material toward the horizontal and toward the backing member in the direction of stroke thereby causing the nap material to raise the upstream backing material to result in the strip moving up and down with respect to the support surface.

* * * * *